United States Patent [19]

Nakata

[11] Patent Number: 4,538,924

[45] Date of Patent: Sep. 3, 1985

[54] CLOCK DEVICE

[75] Inventor: Shinichi Nakata, Kawasaki, Japan

[73] Assignee: Canon Kabushiki Kaisha, Tokyo, Japan

[21] Appl. No.: 625,588

[22] Filed: Jun. 29, 1984

Related U.S. Application Data

[63] Continuation of Ser. No. 420,114, Sep. 20, 1982, abandoned, which is a continuation of Ser. No. 131,410, Mar. 18, 1980, abandoned.

[30] Foreign Application Priority Data

Mar. 22, 1979 [JP] Japan ..... 54-32200

[51] Int. Cl.[3] ..... G04B 23/02; G04C 21/16

[52] U.S. Cl. ..... 368/74; 368/251

[58] Field of Search ..... 368/72–73, 368/250–251

[56] References Cited

U.S. PATENT DOCUMENTS

| | | | |
|---|---|---|---|
| 4,104,863 | 8/1978 | Kondo | 368/251 |
| 4,152,887 | 5/1979 | Fukuichi | 368/251 |
| 4,355,803 | 3/1981 | Sekine | 368/72 |

*Primary Examiner*—Vit W. Miska

*Attorney, Agent, or Firm*—Fitzpatrick, Cella, Harper & Scinto

[57] ABSTRACT

A clock device having a clock circuit to produce time data outputs of hour, minute and second, and an operational circuit to perform predetermined operations based on the time data outputs from the clock device, wherein the changing information for "day", "hour", and "minute" in the data outputs is forwarded to the operational circuit prior to change in the real time.

10 Claims, 3 Drawing Figures

CLOCK DEVICE

This application is a continuation of application Ser. No. 420,114 filed Sept. 20, 1982, now abandoned, which is a continuation of application Ser. No. 131,410, filed Mar. 18, 1980, now abandoned.

BACKGROUND OF THE INVENTION

1. Field of the Invention

This invention relates to a clock device having a clock circuit to generate time data of "hour", "minute" and "second", and an operational circuit to perform required time operations based on the time data. More particularly, it is concerned with a clock device capable of preventing a time delay in the time data outputs from occurring due to the operational time in the operational circuit.

2. Description of Prior Art

It has heretofore been a practice to take out from the clock circuit, as the time data, "hour", "minute" and "second" signals, or those signals generated at the time of change in "day", "hour", "minute", and "second".

For example, at the instant of changing from "23 o'clock 59 minutes 59 seconds" previous day to 0 o'clock 00 minute 00 second" next day, there are simultaneously produced the "hour", "minute" and "second" signal outputs of "0 hr. 00 min. 00 sec.", or there are sequentially produced changing signal outputs accompanied by operational time delay in the clock circuit per se at the time changing instant in the order of the "second" change, "minute" change, "hour" change and "day" change. When the time alarming is to be performed by the operational circuit using such time data, the operational circuit executes the time alarm operation after it receives the time data, and produces the result of the operation as an output. Incidentially, when the alarm is to be established with respect to a number of hours in the operational circuit, the abovementioned time data are sequentially compared with a number of alarm time data to judge coincidence or non-coincidence in each comparison. As a consequence, a lengthy time period is required for the sequential comparison and operational processings with the result that a delay inevitably occurs in the alarm output during the operational time. This delay time becomes greater as the number of the alarm hour data to be compared increases, which is liable to cause various troubles and inconveniences. A solution to such disadvantage has therefore been longed for.

SUMMARY OF THE INVENTION

It is therefore an object of the present invention to provide a clock device which is capable of removing the above-mentioned disadvantage, and of producing, as outputs, the operational results based on the time data without a time delay.

According to the present invention, the changing outputs of "day", "hour", and "minute" from the clock circuit are produced before the change in the real time takes place, thereby terminating the operation in the operational device upon its receipt of the outputs prior to the changes in the real day, hour, and minute, so that the operational results can be produced as outputs without time delay at the subsequent arrival of a changing output of "second", i.e., at the instant of change in the real hour.

DETAILED DESCRIPTION OF THE PREFERRED EMBODIMENT

In the following, the preferred embodiment of the clock device according to the present invention will be explained in detailed in reference to the accompanying drawing.

Figure 1:
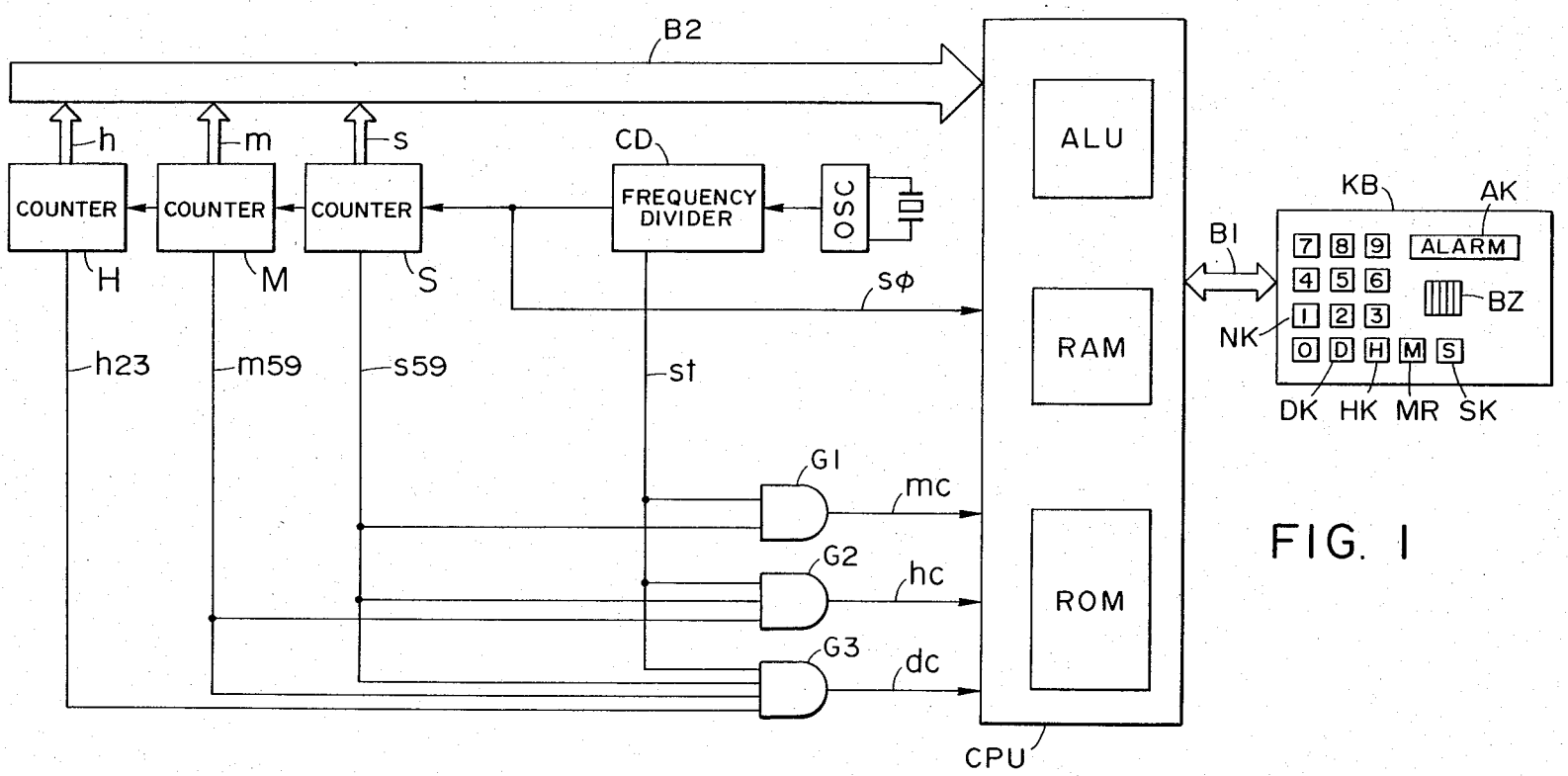
FIG. 1 is a schematic block diagram showing one embodiment of the clock device according to the present invention.

Referring to FIG. 1, a conventional clock circuit is constructed with an oscillator OSC, a frequency divider CD, a modulo-60 binary counter S for counting "second" data, a modulo-60 binary counter M for counting "minute" data, and a modulo-24 binary counter H for counting "hour" data. A reference symbol CPU designates a central operational processor unit capable of performing the abovementioned operation, e.g., multiply time alarm operation, and comprising an operational processing circuit ALU to perform data processing, a memory RAM to store therein data to be processed, and another memory ROM to store therein processing sequences as set forth herewith G1, G2 and G3 respectively refer to "AND" gates to control the central operational processor unit CPU, and KB refers to a keyboard containing therein numerical keys NK for setting alarm hour data, a "day" key DK, an "hour" key HK, a "minute" key MK, a "second" key SK, a time alarm setting key AK, and an alarming buzzer BZ.

Figure 2:
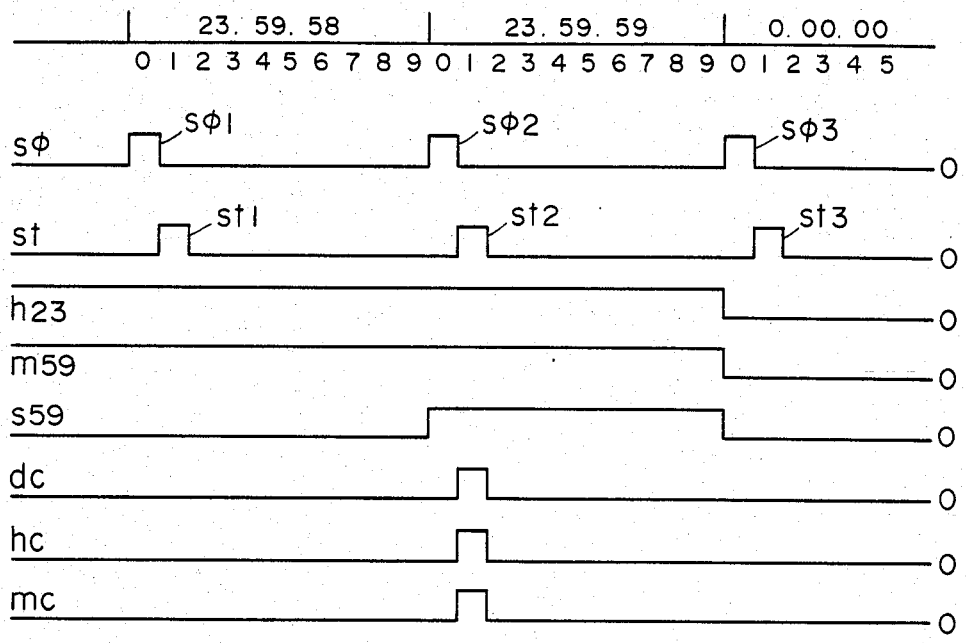
FIGS. 2 and 3 are timing charts showing the signal waveforms appearing in the clock device shown in FIG. 1.

The alarm hour data set by the keyboard KB is transferred to the memory RAM in the central operational processor CPU through a bus B1. A "second" signal s, a "minute" signal m, and an "hour" signal h from the respective counters S, M, and H are transferred into CPU through a bus B2, where they are sequentially compared with a plurality of preset alarm hour data for determining possibility of the hour alarming. In more detail, a strobe signal st which occurs in a definite time relationship with a real time changing signal sϕ representing the real time change in the unit of "second", e.g., at every one second delayed by 0.1 sec. from the signal sϕ, as shown in FIG. 2, is taken out of the frequency divider CD. Signals s59 and m59 which produce an output of the level "1" when the counters S and M have counted "59" are taken out of the counters. A signal h23 which produces an output of the level "1" when the counter H has counted "23" is taken out of the counter. Signals st and s59 are applied to the "AND" gate G1 to obtain these signals st and s59 as the output mc thereof. Signals st, s59 and m59 are to the "AND" gate G2 to obtain these signals st, s59 and m59 as the output hc thereof. Signals st, s59, m59 and h23 are transferred to the "AND" gate G3 to obtain these signals st, s59, m59 and h23 as the output dc thereof. FIG. 2 indicates the relationship between these signals and time.

In the following, operations of the embodiment shown in FIG. 1 will be explained with reference to FIG. 2 showing a time change of from "23 hr. 59 min. 58 sec." to "0 hr. 00 min. 00 sec."

At "23 hr. 59 min. 58 sec.", the signals h23 m59 are already at the level "1", while the signal s59 at the level "0". Therefore, at the instant of a strobe signal st1 occurring at "23 hr. 59 min. 58.1 sec.", the outputs dc, hc, and mc from the "AND" gates are at the level "0". Next, when the time data changes to "23 hr. 59 min. 59 sec.", the signal s59 assumes the level "1", and, at the instant of the strobe signal st2 occurring at "23 hr. 59 min. 59.1 sec." the output signal mc at the level "1" is produced from the "AND" gate G1, and the output signal hc at the level "1" is produced from the "AND" gate G2, and the output signal dc at the level "1" is produced from the "AND" gate G3.

In the following, explanations will be given in reference to FIG. 2 as to a case where the hour alarming output is required just at "0 hr. 00 min. 00 sec." in the central operational processor CPU. In the clock device shown in FIG. 1, the processing sequences are programmed beforehand in the memory ROM so that, when these three input signals dc, hc and mc are introduced therein, the central operational processor CPU may perform desired operations, e.g., comparative operations between a plurality of set alarm hours and "day", "hour", and "minute" informations and the time data transferred through the bus B2. In more detail, when the signal level of the "AND" gate outputs dc, hc and mc are all at the level "1", it performs comparative operations on all the "day", "hour" and "minute" information in the time data, to which one second has been added against the alarm hours; when the signal level of the "AND" gate outputs hc and mc are at the level "1", it compares the "hour" and "minute" information in the time data, to which one second has been added, with the alarming hours; and, when the signal level of the "AND" gate output mc alone is at "1", it performs the comparative operations with respect to the time data, to which one second has been added. It should be understood here that the entire comparative operation in the central operational processor unit CPU will have been completed before a real time changing signal occurs and that such real time changing signal will occur after at least one output at the level "1" has been produced by the "AND" gates G1, G2 and G3. Although the embodiment in FIG. 2 shows a case wherein the operation is completed in 0.9 sec., if the operation requires a long time period such as 2 or 3 seconds, the signal to be taken out of the counter S in place of the signal s59 may be chosen appropriately such as, for instance, the output signal s58 to be produced when the counter has counted "58", or the output signal s57 when the counter has counted "57".

In the operations of the device shown in FIG. 2, the level of the signals dc, hc and mc is respectively "1" at the instant of "23 hr. 59 min. 59.1 sec.", and the comparative operations are commenced in the central operational processor CPU between a plurality of the alarming hours as established and the "day", "hour", "minute" and "second" information in the time data, to which one second has been added. In the central operational processor CPU, the processing sequences are so programmed in the memory ROM that the results of the comparative operations between the alarm hour "0 hr. 00 min. 00 sec." and the time data "23 hr. 59 min. 59 sec.", to which a second has been added, may be produced as outputs when the real time changing signal sϕ3 occurs which is subsequent to the strobe signal st2 (in the embodiment shown, the real time changing signal sϕ3 corresponding to "0 hr. 00 min. 00.0 sec.") being introduced as an input into the central operational processor CPU. In this embodiment, therefore, when the time becomes "0 hr. 00 min. 00.0 sec.", the operational result of the hour alarming for "0 hr. 00 min. 00 sec.", i.e., the actuation of the buzzer BZ in the keyboard KB, is produced as an output in response to the signal sϕ3 at that instant.

Figure 3:
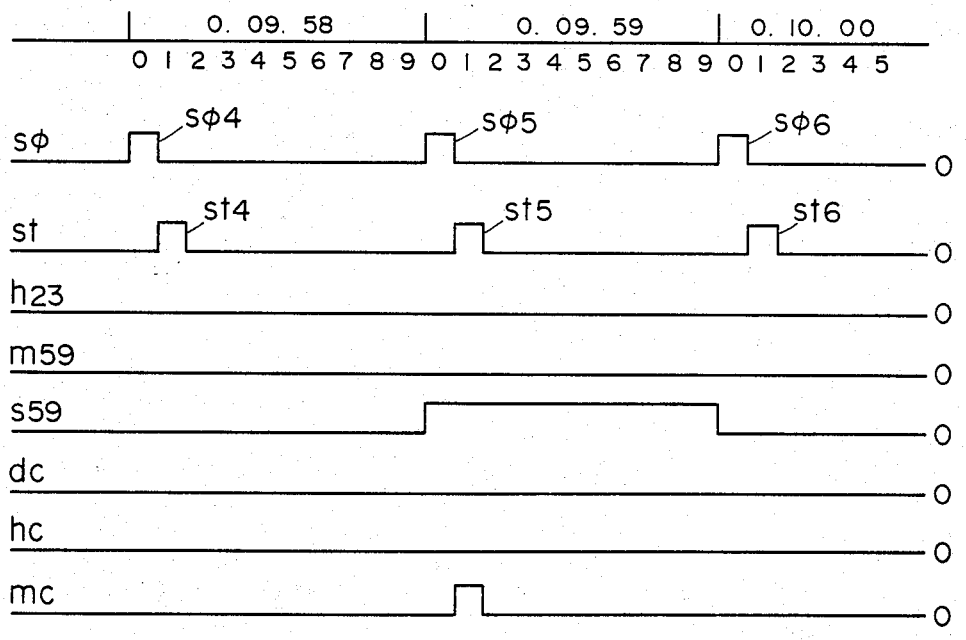

In the following, explanations will be given with reference to FIG. 3 of a case wherein the hour alarm output is produced just at "0 hr. 10 min. 00 sec.". At "0 hr. 9 min. 58 sec.", since the signals h23, m59 and s59 are respectively at the level "0", the outputs dc, hc and mc from the "AND" gates at the instant when the strobe signal st4 occurs at "0 hr. 9 min. 58.1 sec." are at the level of "0". Next, when the time data changes to "0 hr. 9 min. 59 sec.", the signal s59 alone assumes the level "1", and, at the instant of the strobe signal st5 occurring at "0 hr. 9 min. 59.1 sec.", the signal mc at the level "1" is produced as an output from the "AND" gate G1 alone. The respective outputs hc and dc from the other "AND" gates G2 and G3 are at the level of "0". Since the signal mc of the level "1" alone is introduced as an input into the central operational processor, CPU, a desired operation such as, for example, comparative operation of the "minute" and "second" data out of a plurality of established alarming hours with the data obtained by adding one second to the time data which are transferred thereinto through the bus B2, can be done. In view of the fact that the central operational processor unit CPU has already compared, at the instant of "23 hr. 59 min. 59 sec." previous day, the day and the hour as changed (i.e., the day and the hour when the time data have changed from "23 hours" previous day to "0 hour" subsequent day) with all data of a plurality of established alarming hours, it is only necessary that, at "0 hr. 9 min. 59 sec.", the "minute" data in a plurality of the alarming hours as set, in which the hour data have become coincident, be compared with the "minute" data obtained by adding one second to the time data to be transferred through the bus B2. When these data become coincident, the hour alarm output is produced at "0 hr. 10 min. 00.0 sec." with the timing of the real time changing signal sϕ6 which occurs just at "0 hr. 10 min. 00 sec." following the strobe signal st5 which occurs at "0 hr. 9 min. 59.1 sec.".

As has been explained in the foregoing, the output signal mc at the level "1" is produced from the "AND" gate G1 at a time interval of 60 seconds, and the central operational processor CPU which has received mc="1", hc="0", and dc="0" compares the "minute" data out of the time data transferred through the bus B2 with the "minute" data, of which the "hour" data have become coincided among a plurality of the set alarming hours. When the output signal hc at the level "1" is produced from the "AND" gate G2 at a time interval of 60 minutes, the signal mc assumes the level "1", and the central operational processor CPU which has received mc="1", hc="1", and dc="0" compares the "hour" and "minute" data out of the data obtained by adding one second to the time data transferred through the bus B2 with the "hour" and "minute" data in a plurality of the set alarm hours. Further, when the output signal dc at the level "1" is produced from the "AND" gate G3 at a time interval of 24 hours, the signal hc and mc are respectively at the level of "1", and the central operational processor CPU which has received mc="1", hc="1"and dc="1" compares the time data transferred through the bus B2 i.e., the data obtained by adding one second to the "day", "hour" and "minute" data with the "day", "hour" and "minute" data of the plurality of set alarm hours. Once the "day" or "minute" data has been compared, the "minute" data alone is compared at a time interval of 60 seconds, and, when the "day", "hour" and "minute" are all coincided prefectly, the hour alarm output is produced without causing time delay with respect to the established alarming hours with the timing of the real hour changing signal sϕ thereafter, thereby actuating the buzzer BZ in the keyboard KB.

Thus, according to the present invention, when the result of the time operations by the central operational processor CPU is to be produced as the output, the required time operations are executed in advance of an hour output to be produced and the operational results can be produced as an output simultaneously with the time to be produced as an output. Therefore, for example, even where the comparison operation necessitates a long period of time for comparing the time data from the clock circuit with a plurality of the set alarm hours, the operational result can be produced as an output without time delay with respect to the established hour.

What I claim is:

1. A clock device, comprising:

means for generating digital signals representative of running time data;

means for entering fixed time data into said device for indicating a fixed time;

means for determining a predetermined period of time in advance of the fixed time when the running time data and fixed time data will actually coincide and for generating a coincidence signal after the predetermined period of time has elapsed in response to the advance determination of coincidence; and means responsive to said coincidence signal for generating an alarm at the fixed time.

2. A clock device according to claim 1, wherein said means for determining includes means for producing additional time data.

3. A clock device according to claim 2, wherein said means for determining includes means for adding additional time data to said running time.

4. A clock device according to claim 1, further comprising means for generating a timing signal for timing said coincidence detection.

5. A clock device according to claim 3, further comprising means for generating a timing signal for timing said coincidence detection.

6. A clock device according to claim 1, further comprising means for generating a signal indicative of said predetermined time period.

7. A clock device according to claim 1, wherein said means responsive to said coincidence signal comprises a buzzer.

8. A clock device, comprising:

timekeeping means for providing running time data;

memory means for storing an alarm time; and signalling means for generating a signal indicating that the alarm time will arrive after the lapse of a predetermined period of time by beginning a comparing operation to compar the running time data and the alarm time in advance of the alarm time by the predetermined period of time and for outputting the signal after the predetermined period of time has elapsed from the beginning of the comparing operation.

9. A clock device according to claim 8, further comprising input means for entering the alarm signal into said memory means.

10. A clock device according to claim 9, wherein said signalling means includes a buzzer.

* * * * *

UNITED STATES PATENT AND TRADEMARK OFFICE

CERTIFICATE OF CORRECTION

PATENT NO. : 4,538,924

DATED : September 3, 1985

INVENTOR(S) : SHINICHI NAKATA

It is certified that error appears in the above-identified patent and that said Letters Patent is hereby corrected as shown below:

Column 2, line 28, after "herewith" insert --.--; and
line 66, after "s59" insert --is--.

Column 6, line 25, change "compar" to --compare--.

Signed and Sealed this

*Twenty-ninth* Day of *July 1986*

[SEAL]

*Attest:*

DONALD J. QUIGG

*Attesting Officer*

*Commissioner of Patents and Trademarks*